US006283104B1

(12) United States Patent
Ito et al.

(10) Patent No.: US 6,283,104 B1
(45) Date of Patent: Sep. 4, 2001

(54) IGNITION SYSTEM FOR INTERNAL COMBUSTION ENGINE

(75) Inventors: Takashi Ito, Nakamachi; Ryoichi Kobayashi, Tokaimura; Katsuaki Fukatsu, Urizuramachi, all of (JP)

(73) Assignees: Hitachi, Ltd., Tokyo; Hitachi Car Engineering Co., Ltd., Hitachinaka, both of (JP)

( * ) Notice: Subject to any disclaimer, the term of this patent is extended or adjusted under 35 U.S.C. 154(b) by 0 days.

(21) Appl. No.: 09/526,736

(22) Filed: Mar. 16, 2000

(30) Foreign Application Priority Data

Aug. 3, 1999 (JP) ..... 11-220255

(51) Int. Cl.[7] ..... F02P 1/00
(52) U.S. Cl. ..... 123/644; 123/637
(58) Field of Search ..... 123/644, 620, 123/637

(56) References Cited

U.S. PATENT DOCUMENTS 5,113,840 * 5/1992 Taruya et al. ..... 123/644
5,603,308 * 2/1997 Ooyabu et al. ..... 123/644
5,690,085 * 11/1997 Kawamoto ..... 123/644
5,775,310 * 7/1998 Ito et al. ..... 123/644
5,801,534 * 9/1998 Hohner et al. ..... 123/644
5,967,128 * 10/1999 Onuki et al. ..... 123/644

FOREIGN PATENT DOCUMENTS 50-58430 5/1975 (JP) .
57-28871 2/1982 (JP) .
3-121273 5/1991 (JP) .
5-180134 7/1993 (JP) .
9-291870 11/1997 (JP) .
9-324731 12/1997 (JP) .

* cited by examiner

*Primary Examiner*—John Kwon
(74) *Attorney, Agent, or Firm*—Crowell & Moring LLP

(57) ABSTRACT

A current on the primary side of an ignition coil is subjected to repeated conduction/cutoff control in accordance with an ignition control signal of an ECU to thereby generate a high voltage for ignition twice or more in one combustion stroke. In such a multiple ignition system for an internal combustion engine, the primary current of the ignition coil is detected by a resistor to thereby make the ECU recognize the fact that the primary current has reached a value not smaller than a set value through a signal line when the primary current becomes not smaller than the set value. The ECU determines cutoff timing in the second-time et seq. in the repeated conduction/cutoff control on the basis of the recognition.

5 Claims, 9 Drawing Sheets

IGNITION SYSTEM FOR INTERNAL COMBUSTION ENGINE

BACKGROUND OF THE INVENTION

The present invention relates to an ignition system for an internal combustion engine, and particularly to an ignition system for generating a high voltage for ignition twice or more per combustion stroke by repeating conduction/cutoff of a primary current in accordance with an ignition control signal.

In the background art, in a spark igniter for an internal combustion engine using an ignition plug, a so-called multiple ignition method for inducing, not once but repeatedly, a high voltages on the secondary winding of an ignition coil in one combustion stroke to thereby make an ignition plug spark several times for the purpose of improving ignitability of mixture has been proposed as disclosed in JP-A-50-58430.

An example of an igniter using such a multiple ignition method as known in the background art will be described below with reference to FIGS. 8 and 9.

FIG. 8 illustrates a portion corresponding to one cylinder in an independent ignition type igniter provided with independent ignition coils for ignition plugs in cylinders, respectively, of an engine.

In FIG. 8, the reference numeral 1 designates a battery; 2, an engine control unit (hereinafter abbreviated as "ECU"); 3, an ignition coil; 4, an ignition plug; and 5, an igniter unit (ignition circuit).

The igniter unit 5 includes a power transistor (switching device) 9 for controlling conduction and cutoff of a primary current, and a combination of a primary current sensing resistor 10 and a current limiter 11 for serving as a protecting function. The igniter unit 5 is contained in a unit casing integrated with a body casing of the ignition coil.

The ECU 2 calculates the value of a lead angle and the time of current conduction on the basis of the temperature of cooling water, intake pressure, the rotational speed of the engine, etc., and supplies high and low pulses to a base of the power transistor 9 of the igniter unit 5 in proper timing to thereby perform on/off control of the power transistor 9. As a result, the current (primary current) on the primary winding 6 of the ignition coil 3 is conducted and cut off, so that a high voltage is generated on the secondary winding 7 of the ignition coil 3.

The primary winding 6 of the ignition coil 3 is connected, at its one end, to a positive electrode of the battery 1, and connected, at its other end, to a collector terminal of the power transistor 9. The secondary winding 7 is connected, at its one high-voltage-side end, to the ignition plug 4 through a high-voltage diode 8 for preventing premature ignition, and connected, at its other end, to the battery 1.

FIG. 9 shows waveforms in the operation of multiple ignition by conduction and cutoff of the primary current.

In FIG. 9, the reference numeral 12 designates an ignition control signal output repeatedly from the ECU 2 in one combustion stroke; 13, a primary current on the primary winding of the ignition coil 3; and 14, a secondary voltage generated on the secondary winding of the ignition coil 3 and between electrodes of the ignition plug 4.

When the ignition control signal (pulse) 12 is applied to the switching device 9 in the ignition circuit, the primary current 13 begins to flow after a time lag proportional to a time constant defined by inductance and resistance. Under such a condition, the level of the ignition control signal becomes low in proper ignition timing after the start of current conduction. As a result, the primary current is cut off, so that a high voltage is generated between electrodes of the ignition plug 4. The ignition control signal is applied again to the switching device 9 with the passage of time determined by the ECU 2, so that the primary current begins to flow again. In this occasion, however, the next current conduction in the primary winding restarts in a condition that the previous discharging operation has not completed yet. Hence, the primary current jumps up by several amperes because of the influence of residual energy. Then, the primary current begins to flow with a time lag proportional to the time constant. In the third-time current conduction, the primary current jumps up more greatly in terms of waveform.

It can be conceived that the current sensing resistor 10 and the current limiter 11 are used to prevent the primary current from exceeding a predetermined limit value to thereby protect circuit elements even if the aforementioned jump-up occurs. Such a current limiting function keeps the primary current constant by making the power transistor unsaturated. Accordingly, the energy consumed in this condition depends on the power transistor, so that the power transistor generates excessive heat. Moreover, in repeated multiple discharge, it is wasteful to keep the conducting current within the limit value because it is ideal to perform repeated conduction and cutoff of the primary current in a time as short as possible. Incidentally, current limiters for limiting such a primary current by methods other than the multiple ignition method are disclosed in JP-A-5-180134, JP-A-9-291870, JP-A-9-324731, etc.

In the case of the multiple ignition method, the following technique has been proposed for the purpose of supplying stable ignition energy.

For example, JP-A-57-28871 has proposed a system having a device for detecting a primary current flowing in the primary winding, and a device for detecting a secondary current flowing in the secondary winding. The proposed system further has a multiple ignition signal generating circuit to execute a cycle in which a power switching device for conduction and cutoff of the primary current is turned on again to conduct the primary current when the current in the secondary winding is reduced to a value not larger than a predetermined value (that is, when an igniting operation is performed), and the power switching device is turned off when the primary current reaches the predetermined value. In this manner, the proposed system performs multiple ignition.

On the other hand, JP-A-3-121273 has disclosed means of integrating the primary current and controlling the cutoff of the primary current when the integrated primary current value exceeds a set value.

SUMMARY OF THE INVENTION

An object of the present invention is to provide an ignition system which is adapted to a multiple ignition system for an internal combustion engine and in which repeated conduction and cutoff control of a primary current can be performed stably by a novel method different from the background-art method and without any complicated structure of an ignition circuit so that a power switching device, etc., is prevented from generating excessive heat, etc.

To achieve the foregoing object, the present invention is basically configured as follows.

(1) According to a first aspect of the present invention, the above object is achieved by an ignition system for an internal combustion engine, comprising an engine control unit (ECU) for generating an ignition control signal for the internal combustion engine, and an ignition circuit for performing conduction and cutoff of a current (primary current) on a primary winding of an ignition coil in accordance with the ignition control signal to thereby generate a high voltage on a secondary winding of the ignition coil, whereby conduction and cutoff of the primary current is controlled so as to be performed repeatedly in accordance with the ignition control signal so that the high voltages for ignition are generated twice or more per combustion stroke of the internal combustion engine, wherein: the ignition system further comprises communication means for detecting the primary current of the ignition coil and making the engine control unit recognize a fact that the primary current reaches a value not smaller than a set value when the communication means detects the fact; and the engine control unit is set so that cutoff timing in a second-time et seq. of the repeated conduction/cutoff control of the primary current in one combustion stroke is determined in accordance with the recognition of the fact.

With the aforementioned configuration, when the primary current is subjected to repeated conduction and cutoff control in one combustion stroke on the basis of the ignition control signal repeatedly delivered from the ECU to the ignition circuit, a recognition signal is ignored in cutoff of the primary current in the first-time because the primary current in the first-time needs to be cut off in timing calculated accurately by the ECU. In the second-time et seq. in the repeated conduction and cutoff control of the primary current, the energy of the previous ignition remains in the primary coil, so that the primary current jumps up because of the influence of the residual energy. As a result, the primary current reaches the set value (the set value required for securing ignition energy) in a shorter time than the currentconduction time in the first-time. The fact that the primary current has reached the set value is recognized by the ECU through the communication means and primary current sensing means. The ignition control signal falls down on the basis of this recognition to thereby cut the primary current off in the timing that the primary current has reached the set value so that the secondary voltage for ignition can be induced. Accordingly, the primary current can be cut off at an always approximately constant value without any influence of the residual energy on the jump-up of the primary current, so that stable ignition energy can be supplied.

Particularly according to this aspect of the present invention, the ignition control signal calculated accurately by the ECU is held in high regard (in other words, conduction/cutoff control of the primary current is performed faithfully in accordance with the ignition control signal generated in the ECU) in the first-time in one combustion stroke whereas the primary current is cut off when the primary current becomes a value not smaller than the set value in the second-time et seq. in the repeated conduction/cutoff control of the primary current in which the jump-up phenomenon may be caused. Accordingly, there can be achieved an ignition system in which repeated ignition control is performed more accurately so that a stable igniting operation is guaranteed and in which the burden imposed on the power switching device is lightened.

Further, the ECU is made to recognize the fact that the primary current has reached the set value so that the ECU performs the falling control of the ignition control signal for cutoff of the primary current under the above recognition. Thus, it becomes possible to perform stable multiple ignition control by a simple circuit configuration without any ignition circuit. For example, in comparison with the igniter described in JP-A-57-28871, it is not necessary to detect the value of the current actually flowing in the secondary winding to thereby control generation of the primary current in next-time as described above in the background art. Moreover, the size of the ignition circuit can be reduced economically advantageously compared with the background-art method in which the primary current is integrated and the primary current is cut off when the integrated value of the primary current exceeds a set value as described in JP-A-3-121273.

(2) According to a second aspect of the present invention, There is provided an ignition system for an internal combustion engine for generating a high voltage for ignition twice or more per combustion stroke by performing control of repeated conduction/cutoff of a primary current of an ignition coil in one combustion stroke, the ignition system comprising an engine control unit for generating an ignition control signal, and an ignition circuit for performing conduction/cutoff of the primary current of the ignition coil on the basis of the ignition control signal, wherein: the engine control unit generates a first ignition control signal in one combustion stroke so that the ignition circuit performs first conduction/cutoff of the primary current in the one combustion stroke on the basis of the first ignition control signal; the ignition circuit includes a circuit (hereinafter referred to as "ignition control signal generator") for repeatedly generating a second ignition control signal et seq. in a predetermined time after the first-time conduction/cutoff of the primary current; and the ignition control signal generator has timer means for setting operating time required for repeatedly generating the second ignition control signal et seq., a capacitor for accumulating a voltage as a source of the ignition control signal with a time constant defined by a resistor and the capacitor, and discharge means for discharging the capacitor instantaneously to cut off the primary current when the primary current becomes a value not smaller than a set value, charging/discharging of the capacitor being repeated in the operating time.

Also in this aspect of the present invention, the ignition control signal is generated repeatedly in one combustion stroke to perform multiple ignition control. Of the ignition control signals, the first-time ignition control signal is generated in the ECU so that the ignition circuit performs conduction/cutoff of the primary current on the basis of the ignition control signal.

In the first-time conduction/cutoff control of the primary current in the multiple ignition control, the primary current needs to be cut off in timing accurately calculated by the ECU. Hence, it is not concerned as to whether the primary current exceeds the set value or not.

In the second aspect of the present invention, the ignition control signal in the second-time et seq. is generated in the ignition circuit. That is, when the ignition control signal in the second-time et seq. is to be generated, a predetermined time is set. A voltage is generated as a source of the ignition control signal in the capacitor with a time constant defined by the capacitance and resistance. The voltage is applied to a power switching device. The capacitor is discharged instantaneously to cut off the primary current when the primary current reaches a value not smaller than the set value. This operation is repeated so that stable multiple ignition can be performed.

Also in the second aspect of the present invention, communication means for making the ECU recognize the fact that the primary current has reached a value not smaller than the set value may be provided. In this case, the ECU can monitor the state of generation of a signal for the recognition to diagnose the operation of the ignition circuit as to whether the ignition circuit operates normally or not.

DESCRIPTION OF THE EMBODIMENTS

Embodiments of the present invention will be described with reference to FIGS. 1 through 7.

Figure 1:
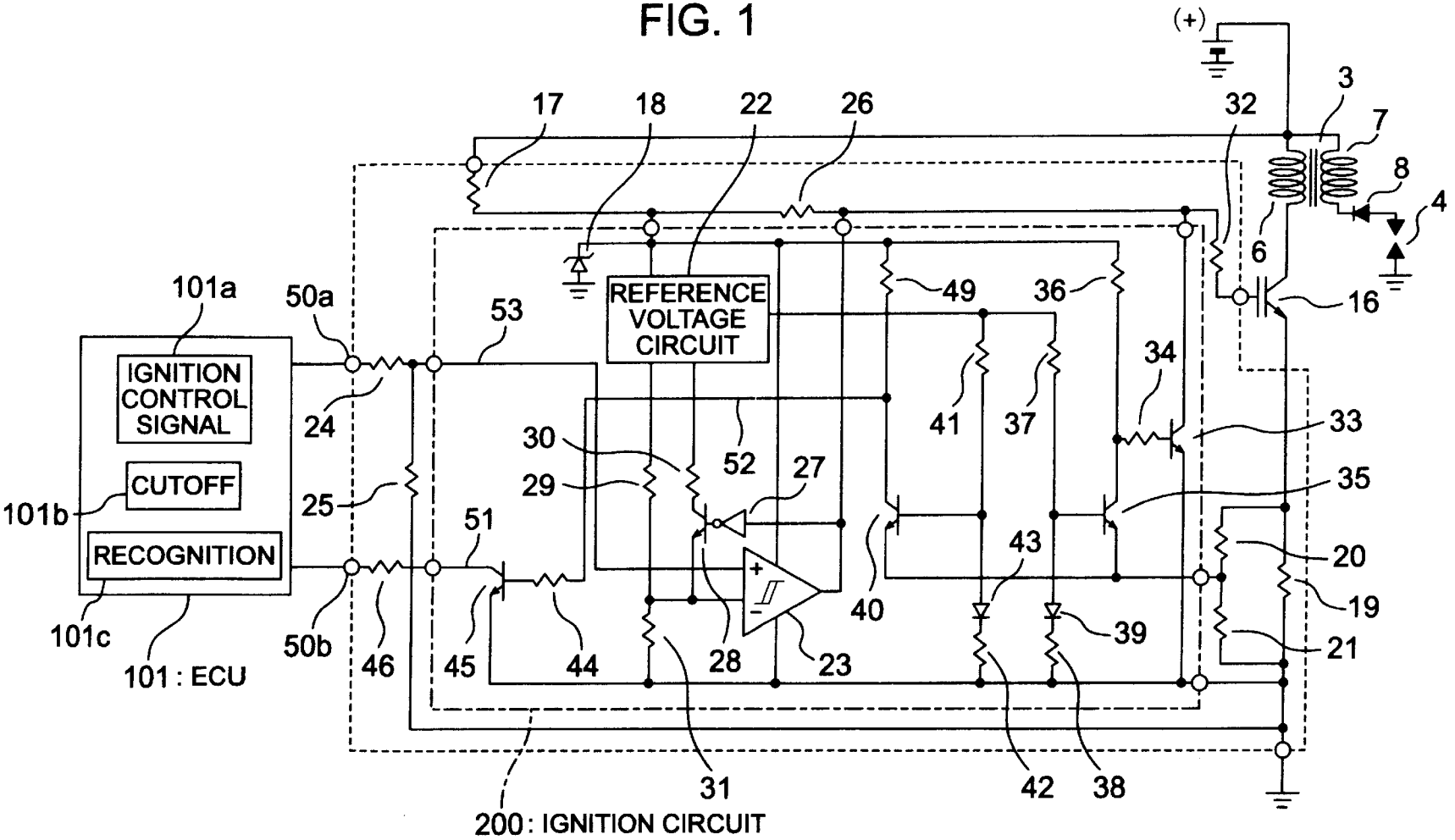
FIG. 1 is a circuit diagram of an ignition system according to a first embodiment of the present invention.
Figure 2:
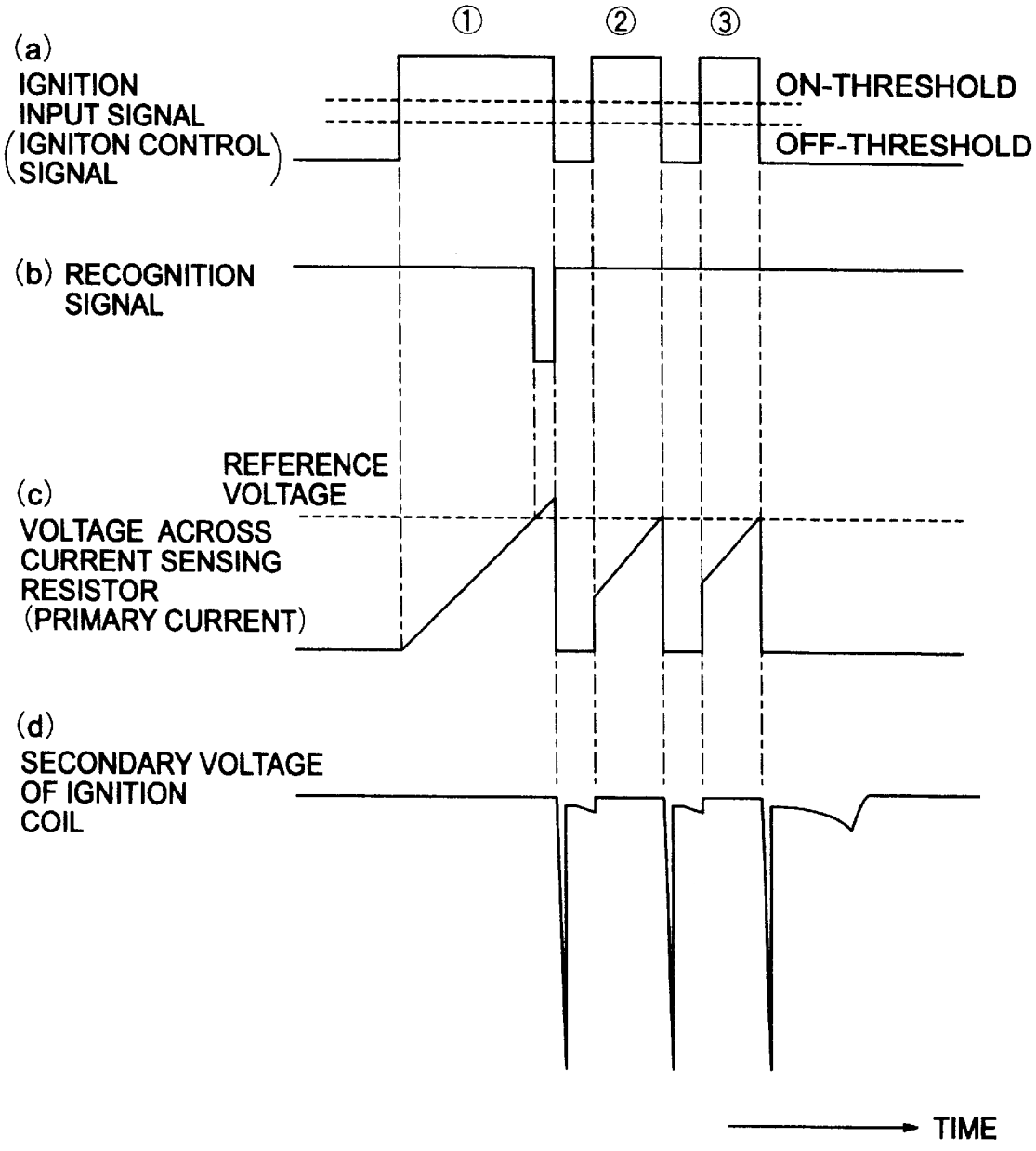
FIG. 2 is a time chart showing the ignition control operation of the ignition system in the first embodiment.

FIG. 1 is a circuit diagram of an ignition system according to a first embodiment of the present invention. FIG. 2 is a time chart showing the ignition control operation of the ignition system.

In FIG. 1, an ignition coil 3 has a primary winding 6 and a secondary winding 7. The primary winding 6 is connected, at its one end, to the positive (+) electrode of a battery, and connected, at its other end, to a collector of an IGBT (insulated-gate bipolar transistor) 16. The IGBT 16 constitutes a power switching device for performing conduction/cutoff of a primary current flowing in the primary winding 6 of the ignition coil 3.

An electric source for an ignition circuit 200 is given from the battery (+) and a constant voltage Vcc is generated by a Zener diode 18 through an input resistor 17.

A current sensing resistor 19 for detecting the primary current is connected to an emitter of the IGBT 16. A voltage generated on the current sensing resistor 19 is divided by resistors 20 and 21.

A reference voltage circuit 22 generates a reference voltage. An inverted input terminal of a hysteresis comparator 23 constituting an input stage for the ignition control signal is supplied with a bias voltage obtained by dividing the reference voltage by a voltage divider of resistors 29 and 31. A non-inverted input terminal of the comparator 23 is connected to an ignition control signal output terminal of an ECU 101 through an input resistor 24 and an ignition control signal input terminal 50*a*.

The input resistor 24 serves as a protection device against the outside and has a resistance value as small as possible. A pull-down resistor 25 is provided for securing a contact current.

An output of the comparator 23 is connected to the downstream side of a resistor 26 to control the gate voltage of the IGBT 16. The output of the comparator 23 is also connected to a buffer 27 so that a current controlled by the buffer 27 controls a transistor 28 to change the bias voltage at the inverted input terminal of the comparator 23 to thereby provide hysteresis in the circuit.

The ECU 101 generates an ignition control signal repeatedly. When the level of the ignition control signal is low, the level of the output of the comparator 23 is low. In this occasion, the transistor 28 is turned on through the buffer 27. As a result, the inverted input terminal of the comparator 23 is supplied with a bias voltage obtained by dividing the reference voltage of the reference voltage circuit 22 through a voltage divider of a parallel connection of resistors 29 and 30 together with the resistor 31. The bias voltage serves as a threshold voltage (hereinafter referred to as "ON-threshold voltage") for conduction of the primary current.

If the voltage of the ignition control signal is lower than the ON-threshold voltage (a set value), the primary current does not flow because the level of the output of the comparator 23 is low so that the level of the gate of the IGBT 16 is kept low.

If the voltage of the ignition control signal is not lower than the ON-threshold voltage, the primary current flows because the level of the output of the comparator 23 becomes high so that the level of the gate of the IGBT 16 becomes high. In this timing, a threshold voltage (which serves as a reference set voltage for cutoff of the primary current and therefore which is referred to an "OFF-threshold voltage") applied to the inverted input terminal of the comparator 23 is lowered to a value obtained by dividing the reference voltage of the circuit 22 through the voltage divider of the resistors 29 and 31 because the level of the output of the buffer 27 becomes low so that the transistor 28 turns off. If the level of the ignition control signal is lowered to a value not higher than the OFF-threshold voltage, the primary current is cut off because the level of the output of the comparator 23 becomes low so that the IGBT 16 turns off. By changing the value of the threshold voltage in the aforementioned manner, hysteresis for conduction/cutoff control of the primary current is provided. A gate resistor 32 is inserted in the gate circuit of the IGBT 16 to protect the circuit from a rush current due to the capacitance of the gate, etc.

In this embodiment, in order to make ECU 101 recognize the fact that the primary current subjected to repeated conduction/cutoff control for multiple ignition control becomes a value not smaller than the set value, there is provided communication device in the ignition circuit 200.

That is, the communication device is provided with transistors 40 and 45. The transistor 40 has a base connected between voltage-dividing resistors 41 and 42, a collector connected to the reference voltage circuit 22 through a resistor 49, and an emitter connected to a junction between the primary current sensing resistors (voltage-dividing resistors) 20 and 21. The transistor 45 has a collector connected to the ECU 101 through an exclusive signal line 51 containing a resistor 46 and an output terminal 50*b*, an emitter connected to the ground, a base connected to the collector of the transistor 40 through a resistor 44. The signal lines 51 and 52 containing these circuit elements serve as exclusive signal lines for making the ECU 101 recognize the fact that the primary current has reached a value not smaller than the set value. The operation of the communication means will be described below.

The transistor 40 is provided as an emitter follower configuration in which the emitter is connected to a junction between the current sensing resistors 20 and 21. At a point of time when the voltage at the junction between the primary current sensing resistors 20 and 21 reaches a reference bias voltage value (in other words, at a point of time when the primary current reaches the set value), the next-stage transistor 45 is turned on to thereby supply a recognition signal to the ECU 101 through the signal line 51.

More specifically, a potential (hereinafter referred to as "detection reference voltage") generated between the opposite ends of the resistor 42 by dividing the reference voltage through the voltage dividing resistors 41 and 42 is applied to the base of the transistor 40, so that the base of the transistor 40 is biased by the detection reference voltage. When, for example, the value of the detection reference voltage is set to the value of a voltage drop generated when a primary current of 7A flows in the current sensing resistor 19, the primary current of 7A flowing in the IGBT 16 can be detected. The collector of the transistor 40 is pulled up to Vcc by the resistor 49 and connected to the base of the transistor 45 through the resistor 44. The emitter of the transistor 45 is connected to the ground. The collector of the transistor 45 is connected to the signal output terminal 50*b* through the resistor 46 having a small resistance value in a range of from about 10 to about 1000Ω. The transistor 45 is in an off state so long as the primary current is smaller than 7A. When the primary current reaches a value not smaller than 7A, the transistor 45 turns on and issues an ON signal (low level). Upon detection of the ON signal, the ECU 101 can recognize the fact that the primary current has reached a value not smaller than the set value.

The ECU 101 is constituted by a micro-computer. The ECU 101 has a function (ignition control signal generating unit 101*a*) for calculating the lead angle value of ignition and the repetition frequency of the multiple ignition control signal on the basis of a control map in accordance with the engine conditions (the temperature of coolant, the intake pressure, the rotational speed of the engine, etc.), and a function (recognition unit 101*c*) for recognizing the fact that the primary current has reached a value not smaller than the set value on the basis of the ON/OFF signal of the transistor 45. The ECU 101 further has a function (primary current cutoff control unit 101*b*) for controlling cutoff timing of the primary current in the second-time et seq. in one combustion stroke by performing falling control of the ignition control signal (pulse) repeatedly generated in accordance with the recognition in the second-time et seq. in one combustion stroke.

FIG. 2 is a timing chart showing conduction/cutoff control of the primary current in the embodiment of the present invention described above. FIG. 2 shows, in descending order, the states of the ignition control signal (a) supplied from the ECU 101 to the ignition circuit 200, the recognition signal (b) generated by the transistor 45 of the ignition circuit 200, the primary current (c) flowing in the primary winding 6 of the ignition coil 3, and the secondary voltage (d) generated on the secondary winding 7.

In FIG. 2, the portion ① shows waveforms in the case where current conduction and ignition control is performed on the basis of the ignition control signal in the first-time for multiple ignition. When the ignition control signal (a) reaches a value not smaller than the ON-threshold, the IGBT 16 turns on. As a result, the primary current flows. The voltage between the opposite ends of the current sensing resistor 21 increases as the primary current increases. When the voltage between the opposite ends of the current sensing resistor 21 reaches the detection voltage set value (reference voltage), the level of the recognition signal (b) of the transistor 45 becomes low. In repeated multiple discharge, it is necessary to cut the primary current off in the first-time in timing accurately calculated by the ECU 101, and therefore the recognition signal (b) is ignored.

The portions ② and ③ show current conduction and ignition control in the second-time et seq. in one combustion stroke. The rising timing of the ignition control signal (a) is determined on the basis of calculation by the ECU 101 in advance. When the ignition control signal reaches a value not smaller than the ON-threshold, the primary current flows in the same manner as in the portion ①. The primary current (c), however, jumps up because of the influence of energy remaining in the ignition coil. Hence, the primary current reaches the set value in a shorter time than the current conduction time in the first-time. At this point of time, the level of the recognition signal (b) becomes low. The ECU 101 can recognize the fact that the primary current has reached a value not smaller than the set value on the basis of the recognition signal. In this timing of recognition, the ignition control signal is made to fall down to thereby cut off the primary current.

As described above, in this embodiment, cutoff of the primary current in the second-time et seq. in one combustion stroke is performed on the basis of the recognition of the fact that the primary current has reached a value not smaller than the set value. In the first-time, however, such cutoff control is not performed. Therefore, a primary current limiter is further provided in the ignition circuit in order to prevent the primary current from increasing unexpectedly excessively in the first-time, and in consideration of fail-safe in case of emergency due to a failure in cutoff control of the primary current in the second-time et seq.

The limit value in the primary current limiter is set to be larger than the cutoff value of the primary current. The primary current limiter will be described below.

The transistor 33 is a control transistor for limiting the primary current when the primary current reaches the set value. The transistor 33 has a collector connected to the upstream side of the gate resistor 32 of the IGBT 16, an emitter connected to the ground, and a base connected to a collector of a transistor 35 through a resistor 34. The transistor 35 has a collector connected to Vcc through a pull-up resistor 36, and an emitter connected to a junction between the primary current sensing resistors 20 and 21.

That is, the transistor 35 is provided in the form of an emitter follower coupled with primary current sensing resistors. The base of the transistor 35 is biased by the potential of the resistor 38 in a current limiting reference voltage circuit which is constituted by resistors 37 and 38 and a diode 39 and connected to the reference voltage circuit 22. By the bias value of the resistor 38, the limit value of the primary current is set to be slightly larger than the cutoff value of the primary current.

When the IGBT 16 turns on on the basis of the ignition control signal, the primary current flows so that the potential of the current sensing resistor 19 increases. When the potential at the junction between the resistors 20 and 21 becomes a value not lower than the potential of the resistor 38, the transistor 35 is cut off gradually from the emitter to thereby turn the transistor 33 on. Accordingly, the gate voltage of the IGBT 16 is reduced into an unsaturated state. As a result, Vce increases and the collector current is limited because the potential of the current sensing resistor is approximately equal to the potential of the resistor 38.

By performing the aforementioned operation, multiple ignition energy can be supplied to the ignition coil repeatedly and always stably. Particularly in the second-time et seq. in one combustion stroke, there is no excessive load imposed on the power switching device because the primary current is cut off when it is not smaller than the set value. Moreover, in this embodiment, the burden imposed on the circuit configuration concerning the cutoff of the primary current on the ignition circuit can be lightened because the fact that the primary current has reached a value not smaller than the set value is recognized by the ECU which is constituted by a micro-computer and because falling of the ignition control signal is performed by the ECU under the recognition.

Figure 3:
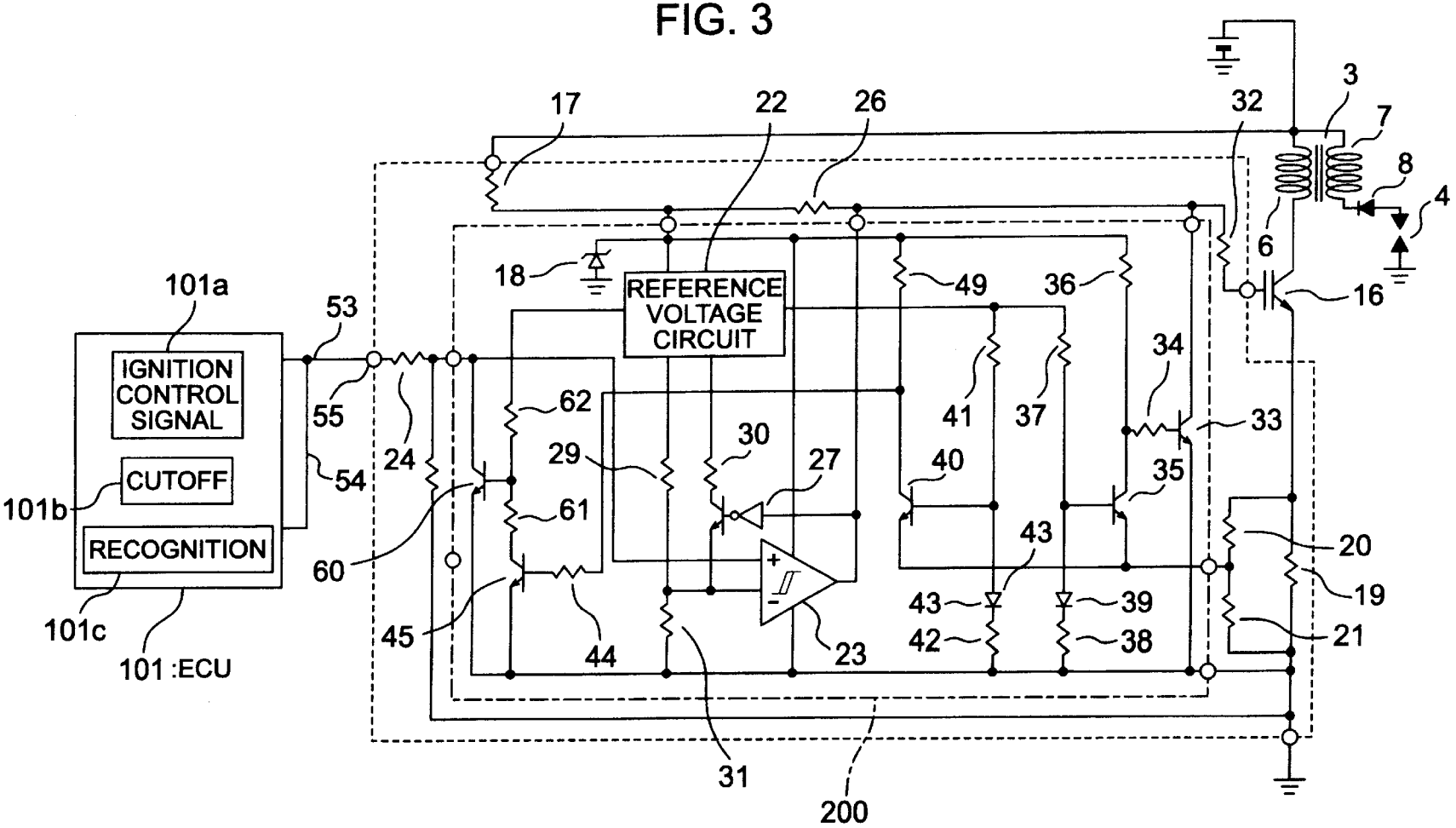
FIG. 3 is a circuit diagram of an ignition system according to a second embodiment of the present invention.

FIG. 3 shows the circuit configuration of the ignition system according to a second embodiment of the present invention.

The basic configuration of the ignition circuit 200 in the ignition system in this embodiment is the same as that in the first embodiment. In FIGS. 1 and 3, like parts are referenced correspondingly.

The second embodiment is different from the first embodiment in the configuration of the communication device in which the ignition circuit 200 makes the ECU 101 recognize the fact that the primary current has reached a value not smaller than the set value when the primary current reaches a value not smaller than the set value. Here, the configuration of the communication means will be mainly described below.

In this embodiment, there is no exclusive output terminal provided to make the ECU 101 recognize the fact that the primary current has reached a value not smaller than the set value. The level of the ignition control signal is changed to thereby form a recognition signal.

To achieve this, the communication means provided on the ignition circuit 200 includes NPN transistors 40 and 45 having the same functions as those in the first embodiment and is further configured as follows.

That is, a collector of the transistor 45 is connected to a base of a PNP transistor 60 through a resistor 61. The base of the PNP transistor 60 is also connected to a pull-up resistor 62 which is connected to the reference voltage circuit 22. A collector of the PNP transistor 60 is connected to the ground. An emitter of the PNP transistor 60 is connected to an ignition control signal input terminal 55 through an input resistor 24.

In this embodiment, after the IGBT 16 turns on on the basis of the ignition control signal so that the primary current flows, the transistor 45 turns on at a point of time when the potential of the current sensing resistor (voltage dividing resistor) 21 reaches the detection reference voltage. As a result, the base voltage of the PNP transistor 60 takes a tap voltage value obtained by dividing the output of the reference voltage circuit by the resistors 62 and 61. As a result, the emitter potential of the PNP transistor 60 is reduced to a value obtained by addition of Vbe to the tap voltage value of the voltage divider. Because the input resistor 24 has a resistance value as small as possible as described above, the emitter potential of the PNP transistor 60 becomes approximately equal to the potential at the ignition control signal input terminal 55. The PNP transistor 60 serves as an element of a variable voltage circuit for changing the potential of the ignition control signal.

The reduction in level of the ignition control signal can be input to the ECU 101 through the ignition control signal line 53 and the input terminal 55 and through a potential sensing signal line 54 branching from the signal line 53. The ECU 101 has a function (recognition unit 101*c*') to recognize the fact that the primary current has reached a value not smaller than the set value by judging the reduction in level of this signal, and a function (primary current cutoff control unit 101*b*) for cutting off the primary current by lowering the level of the ignition control signal to a value not larger than an OFF-threshold (threshold potential for cutting the primary current off) on the basis of the recognition.

Figure 4:
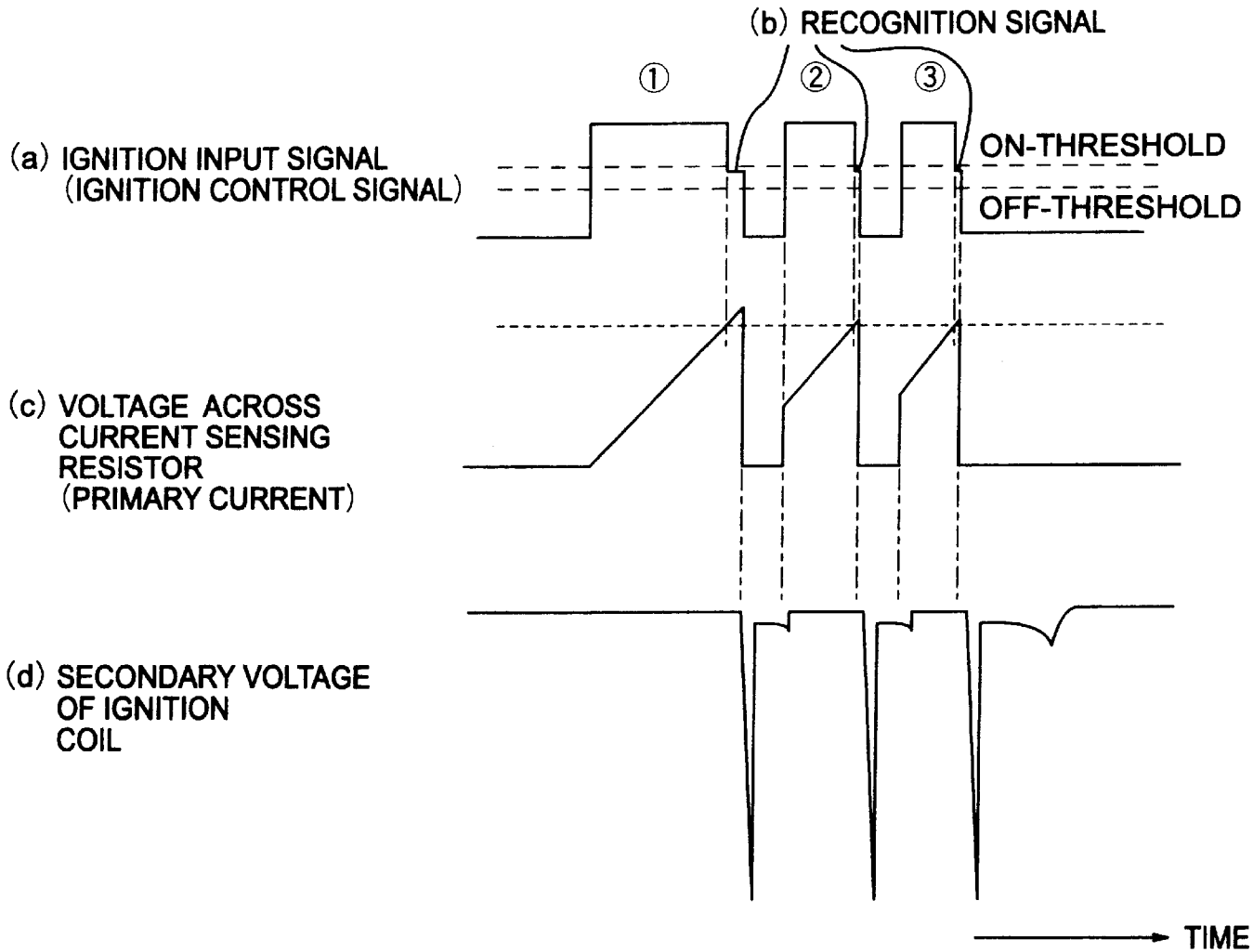
FIG. 4 is a time chart showing the ignition control operation of the ignition system in the second embodiment.

The level of the ignition control signal to be reduced when the primary current reaches a value not smaller than the set value is reduced so as not to be lower than the OFF-threshold potential (threshold potential for performing cutoff control of the primary current; see FIG. 4) of the input comparator 23 supplied with the emitter potential of the PNP transistor 60. That is, the level change of the ignition control signal can be made without influence on conduction control. The level change of the ignition control signal is detected by the ECU 101 so that the fact that the primary current has reached a value not smaller than the set value can be recognized.

FIG. 4 is a timing chart showing conduction/cutoff control of the primary current in this embodiment. FIG. 4 shows, in descending order, states of the ignition control signal (a) supplied from the ECU 101 to the ignition circuit 200, the recognition signal (the level of the ignition control signal reduced when the primary current has reached a value not smaller than the set value) (b) generated by the PNP transistor 60 side of the ignition circuit by use of the ignition control signal, the primary current (c) flowing in the primary winding 6 of the ignition coil and the secondary voltage (d) generated on the secondary winding 7.

In FIG. 4, the portion ① shows waveforms in the case where primary current conduction/cutoff and ignition control is performed on the basis of the ignition control signal in the first- time for repeated multiple ignition.

When the ignition control signal (a) becomes a value not lower than the ON-threshold, the IGBT 16 turns on. As a result, the primary current flows. The voltage (c) between opposite ends of the current sensing resistor increases as the primary current increases. When the voltage value (c) between the opposite ends of the current sensing resistor reaches the detection voltage set value (a reference voltage), the voltage level of the ignition control signal (a) is reduced through the PNP transistor 60 to a value not lower than the OFF-threshold potential. As a result, the fact that the primary current has reached a value not smaller than the set value is recognized by the ECU 101. In this occasion, there is no influence on ignition and current conduction control because the lowering of the voltage level of the ignition control signal (the generation of the recognition signal (b)) performed by a voltage level not lower than the OFF-threshold. It is necessary to cut the primary current off in timing accurately calculated by the ECU in the first-time in repeated multiple discharge, and the recognition signal (b) is therefore ignored.

The portions ② and ③ show ignition control in the second-time et seq. The rising timing of the ignition control signal (a) is determined through calculation by the ECU 101 in advance. When the ignition control signal (a) reaches a value not smaller than the ON-threshold, the primary current flows in the same manner as in the portion ①. The primary current, however, jumps up because of the influence of energy remaining in the ignition coil in the first-time. Hence, the primary current reaches the set value in a shorter time than the current conduction time in the first-time. At this point of time, the voltage level of the ignition control signal (a) is reduced through the power transistor 60. The ECU 101 can recognize the fact that the primary current has reached a value not smaller than the set value on the basis of the reduction in voltage level of the ignition control signal (a). In this timing of recognition, the ignition control signal (a) is made to fall down to thereby cut off the primary current.

According to this embodiment, stable multiple ignition control can be achieved in a sample circuit configuration similarly to the first embodiment. Particularly, any exclusive terminal for communication can be omitted because the communication device makes the ECU 101 recognize the fact that the primary current has reached a value not smaller than the set value by use of the ignition control signal line 53 given from the ECU 101. Hence, the ignition system can be realized as a compact and inexpensive multiple ignition system.

Figure 5:
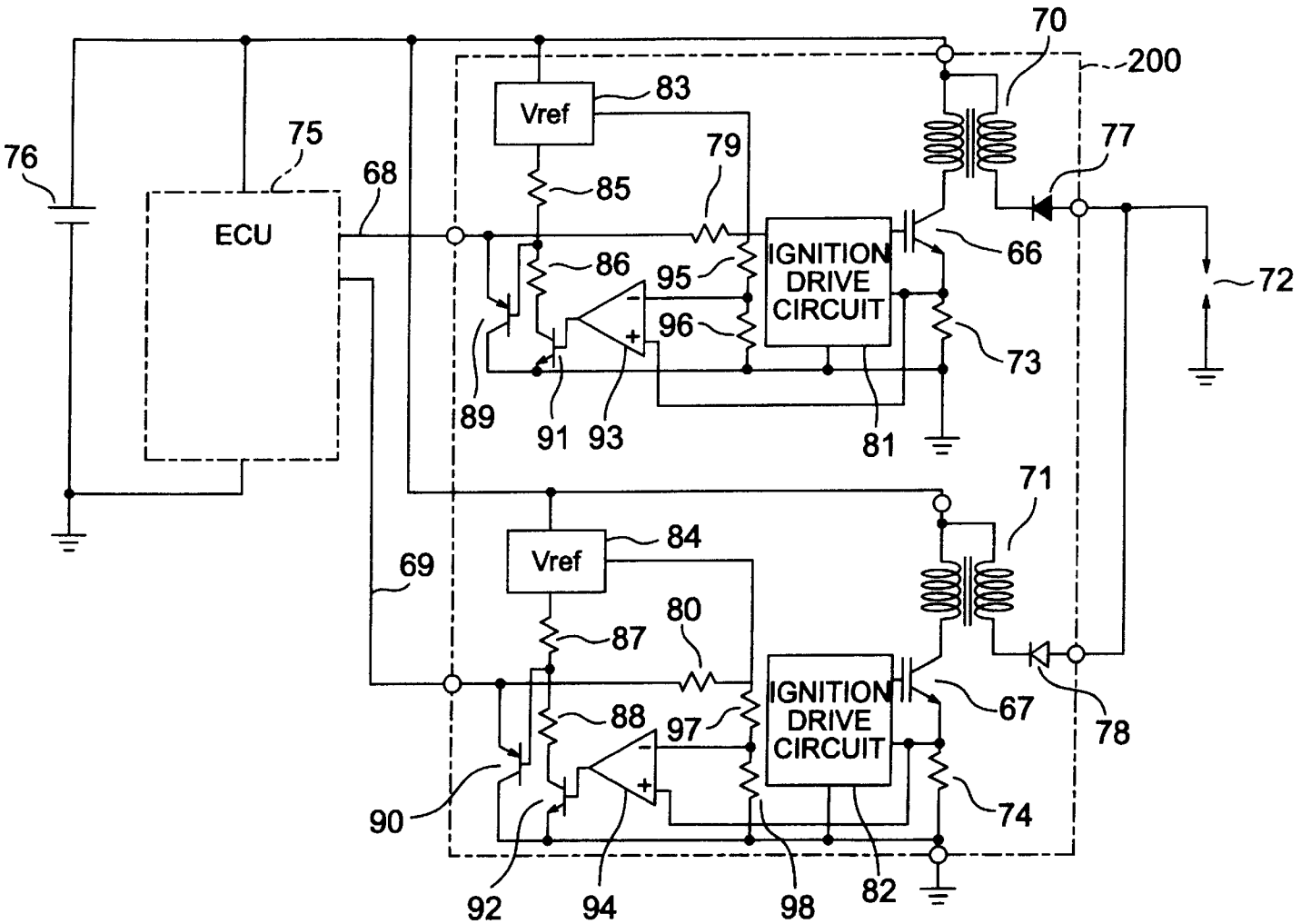
FIG. 5 is a circuit diagram of an ignition system according to a fourth embodiment of the present invention.

FIG. 5 is a circuit diagram of the ignition system according to a third embodiment of the present invention. In the circuit configuration shown in FIG. 5, only one of a plurality of cylinders is depicted.

In this embodiment, multiple ignition control is performed by use of a plurality of ignition coils (two ignition coils in this embodiment) for one ignition plug. The high-voltage sides of the secondary windings of two ignition coils 70 and 71 are connected to one ignition plug 72 through high-voltage diodes 77 and 78 respectively. The withstand voltage of each of the high-voltage diodes 77 and 78 is higher than the secondary voltage.

The reference numeral 76 designates a battery; and 75, an ECU. On the ignition circuit 200, there are Ax provided ignition drivers 81 and 82 for drive-controlling IGBTs 66 and 67 on the basis of the ignition control signal delivered from the ECU 75; primary current sensing resistors 73 and 74; and comparators 93 and 94, NPN transistors 91 and 92 and PNP transistors 89 and 90 which constitute communication device for making the ECU 75 recognize the fact that the primary current has reached a value not smaller than the set value when the primary current reaches a value not smaller than the set value. The reference numerals 83 and 84 designate reference voltage circuits respectively. Each of the ignition drivers 81 and 82 contains a primary current limiter as described above in the first embodiment.

The ignition control signal from the ECU 75 is supplied to the ignition drivers 81 and 82 through input resistors 79 and 80 to perform conduction/cutoff control of the primary currents with a time difference between the two ignition coils 70 and 71. The conduction/cutoff control of the primary currents induces the secondary voltage repeatedly to make one ignition plug 72 carry out a multiple ignition operation. From the point of view of shortening the discharge interrupt time, repeated conduction/cutoff control of the primary current by such multiple ignition coils is advantageous to repeated current conduction by a single ignition coil.

In this embodiment, when the primary currents in the ignition coils 70 and 71 are conduction-controlled in a designated sequence on the basis of the ignition control signal output from the ECU 75, the primary currents are detected by the primary current sensing resistors 73 and 74 respectively. When each of the detected primary currents has reached a value not smaller than the set value, the potential of the ignition control signal is reduced in the same manner as in the second embodiment to thereby make the ECU 75 recognize the fact that the primary current has reached a value not smaller than the set value.

In this embodiment, the comparators 93 and 94, the NPN transistors 91 and 92, the PNP transistors 89 and 90 and ignition control signal lines 68 and 69 constitute communication device for making the ECU 75 recognize the fact that the primary current has reached a value not smaller than the set value.

Inverted input terminals of the comparators 93 and 94 are supplied with voltage values as reference voltage values obtained by dividing the reference voltages Vref of the reference voltage circuits 83 and 84 by a voltage divider of the resistors 95 and 96 and by a voltage divider of the resistors 97 and 98, respectively. Non-inverted input terminals of the comparators 93 and 94 are supplied with voltage values of the primary current sensing resistors 73 and 74 respectively.

If the primary current reaches a value not smaller than the set value upon such a conduction that the voltage value of corresponding one of the sensing resistors 73 and 74 becomes higher than the comparison reference value of corresponding one of the comparators 93 and 94. Accordingly, the output level of the corresponding one of the comparators 93 and 94 becomes high to turn corresponding one of the NPN transistors 91 Ipand 92 on. As a result, the base potential of corresponding one of the PNP transistors 89 and 90 is reduced from Vref to a tap voltage value at a junction between resistors 85 and 86 or at a junction between resistors 87 and 88. As a result, the level of the ignition signal is reduced to a value obtained by addition of Vbe to the tap voltage value. Because the level of the ignition signal is reduced so as not to be lower than the OFF-threshold in the same manner as those in the previous embodiments, the reduction of the level of the ignition signal can make the ECU 75 recognize the fact that the primary current has reached a value not smaller than the set value without giving any influence on ignition control. Hence, cutoff timing of the primary current in multiple ignition control can be controlled. As described above, the primary current cutoff control based on the aforementioned recognition is used for ignition control in the second-time et seq. in one combustion stroke while it is ignored in ignition control in the first-time. Because the signal line and output terminal for making the ECU recognize the fact that the primary current has reached a value not smaller than the set value can serve also as an ignition control signal line, great rationalization of wiring can be achieved in the case where conduction/cutoff control of the primary current is performed by a plurality of ignition coils for one cylinder (one ignition plug).

Figure 6:
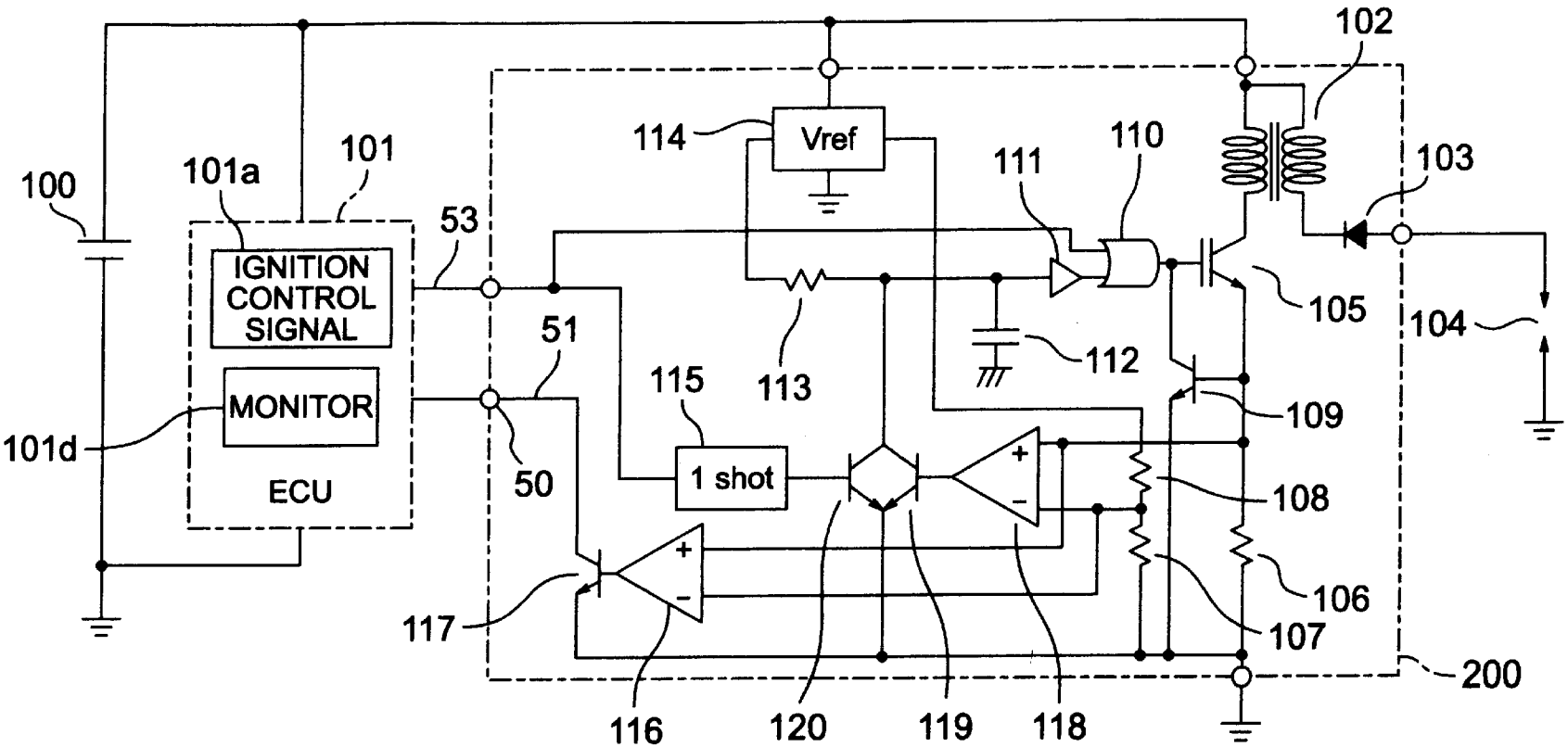
FIG. 6 is a circuit diagram of an ignition system according to a fourth embodiment of the present invention.

FIG. 6 shows only one cylinder in the circuit configuration of the ignition system according to a fourth embodiment of the present invention. In FIG. 6, there are provided a battery 100, an ECU 101, and an ignition circuit 200.

The fourth embodiment is different greatly from the first, second and third embodiments in the following point. In the first, second and third embodiments, the ignition control signal is always generated in the ECU. In multiple ignition control in this embodiment, the ignition control signal at the first-time in repeated ignition control in one combustion stroke is generated in the ECU 101 but the ignition control signal in the second-time et seq. is generated in the ignition circuit 200.

Figure 7:
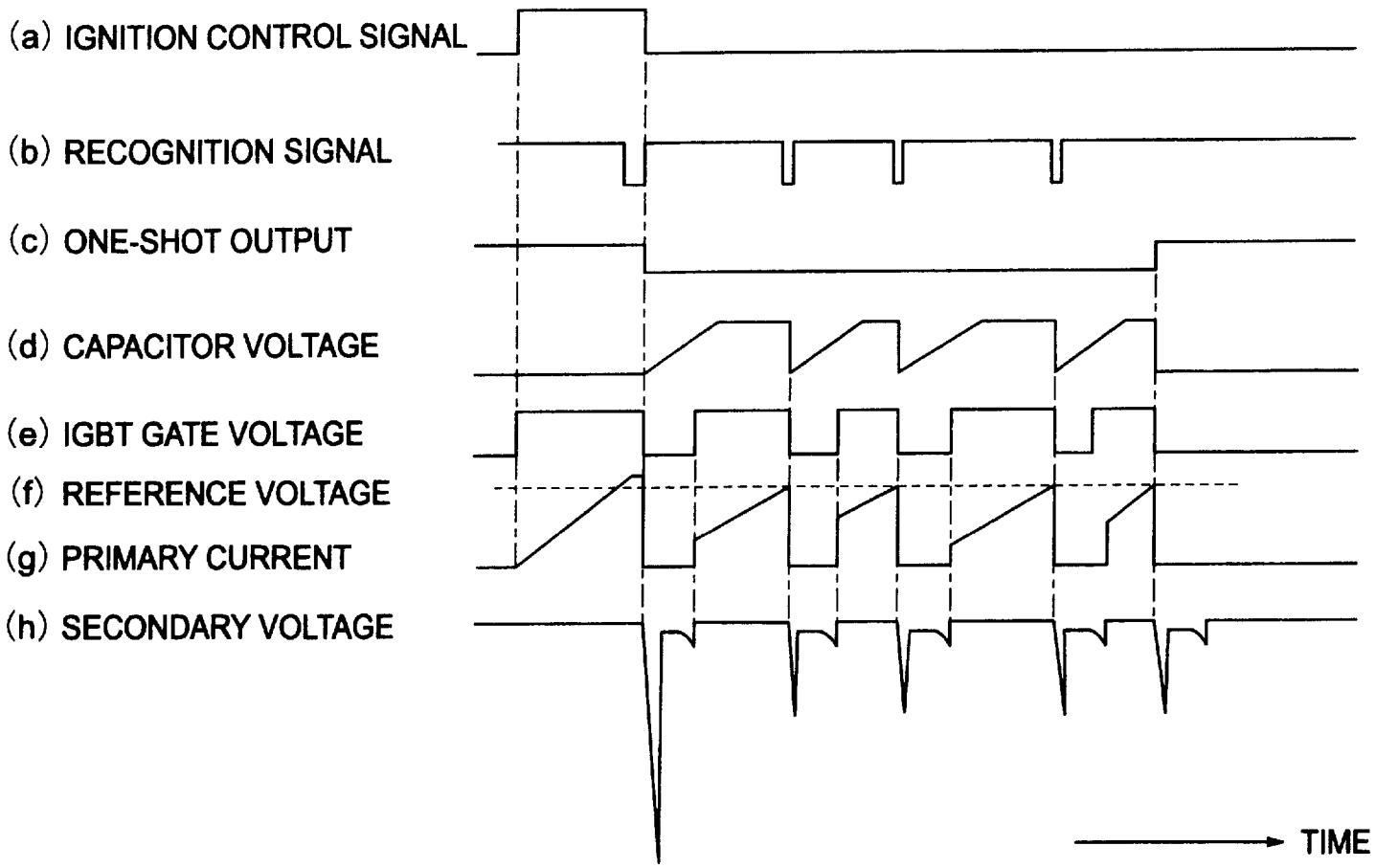
FIG. 7 is a time chart showing the ignition control operation of the ignition system in the fourth embodiment.
Figure 8:
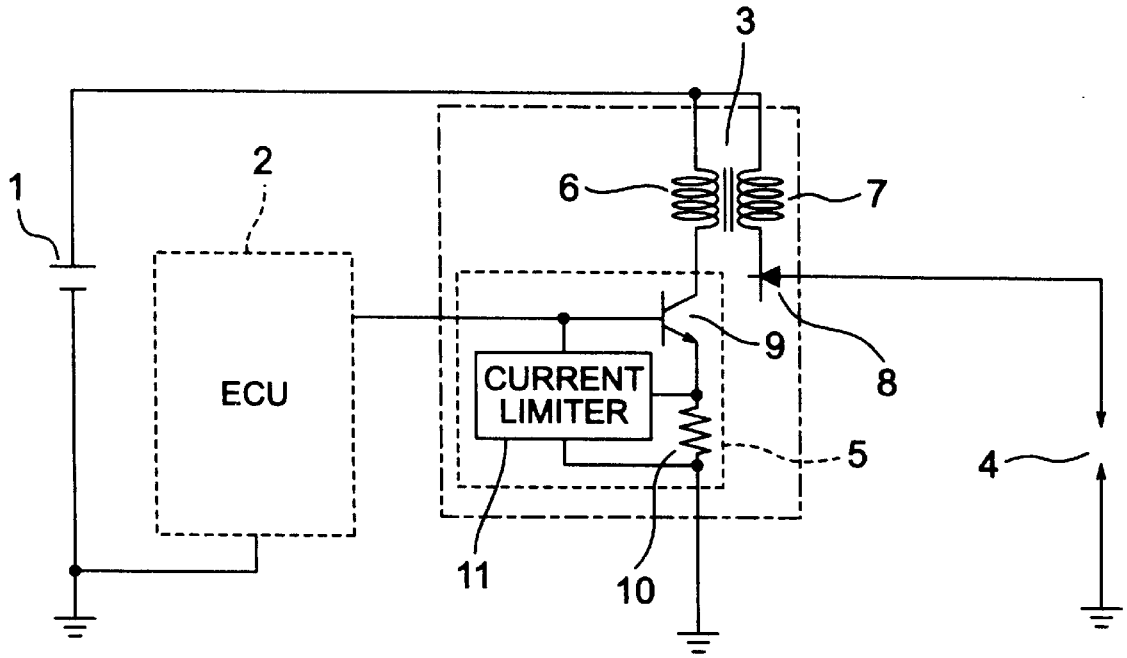
FIG. 8 PRIOR ART
FIG. 8 is a circuit diagram of a backgroundart ignition system.
Figure 9:
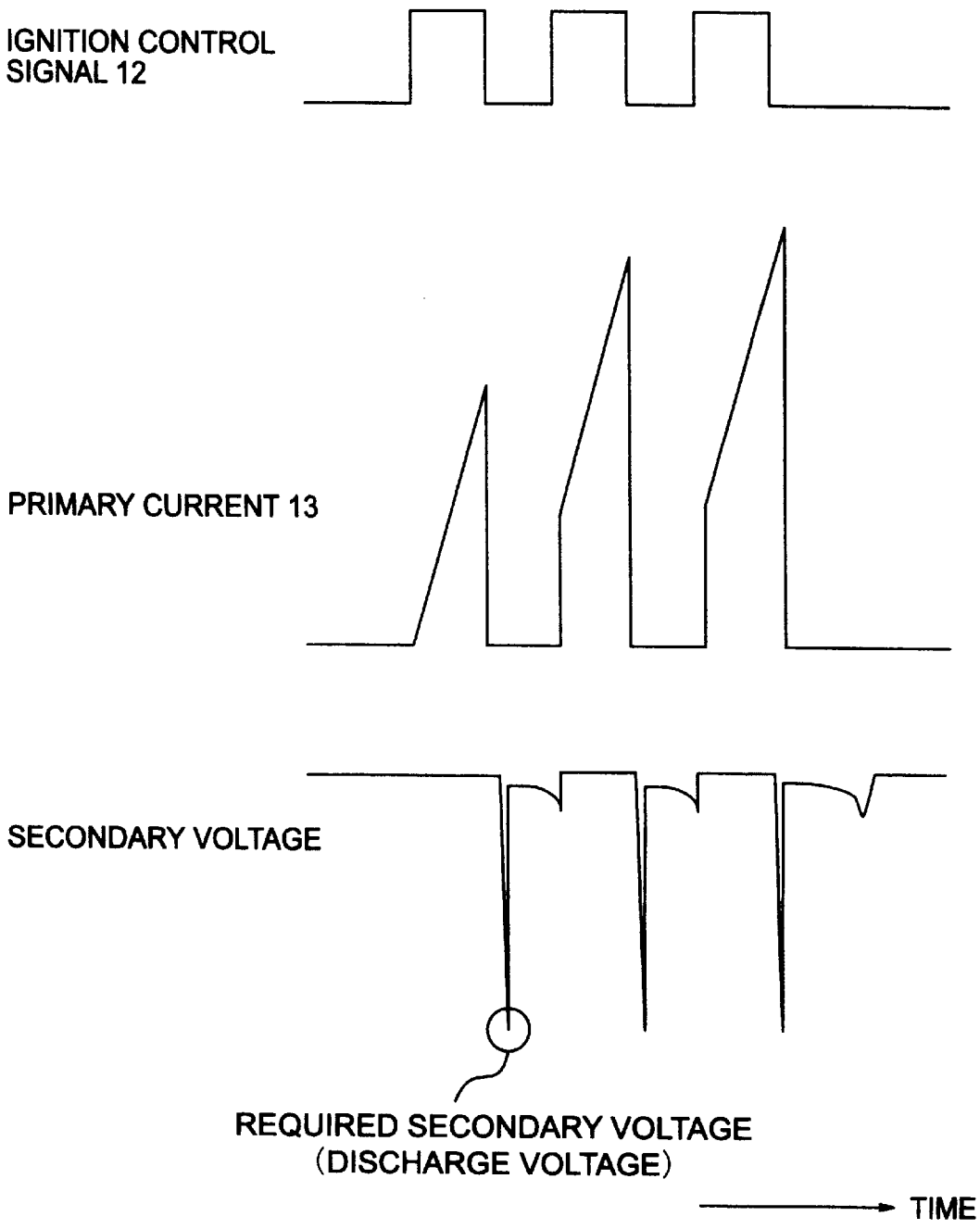
FIG. 9 PRIOR ART
FIG. 9 is a time chart showing the ignition control operation of the background-art ignition system.

Therefore, the ignition control signal generating unit (a calculating unit) 101*a* of the ECU 101 generates an ignition control signal only in the first-time in one combustion stroke (see FIG. 7). On the other hand, the ignition circuit 200 includes an ignition control signal generator for repeatedly generating the ignition control signal in the second-time et seq. in a predetermined time after the conduction/cutoff of the primary current in the first-time.

The ignition control signal generator is provided with: a one-shot circuit (timer device) 115 for setting the operating time required for repeated generation of the ignition control signal in the second-time et seq.; a capacitor 112 in which a voltage as a source of the ignition control signal is charged with a time constant defined by the capacitor 112 and the resistor 113; and a comparator (a discharging device) 118 for cutting off the primary current by discharging the capacitor 112 instantaneously when the primary current has reached a value not smaller than the set value. The ignition control signal generator is configured so that charging/discharging of the capacitor 112 is repeated in the operating time.

A specific example of the circuit in this embodiment is as follows.

An ignition control signal output line 53 and a recognition signal line 51 are used as wiring for connecting the ECU 101 and the ignition circuit 200 to each other. An ignition coil 102 has the high-voltage end which is connected to an ignition plug 104 through a diode 103 for preventing premature ignition. An IGBT 105 serves as a power switching device. In the IGBT 105, a collector is connected to the primary winding of the ignition coil 102, an emitter is connected to the ground through a current sensing resistor 106, and a gate is connected to a primary current limiting transistor 109 and to an output terminal of an OR gate 110 branched from the transistor 109. In the OR gate 110, one input terminal is supplied with the ignition control signal, and the other input terminal is connected to the capacitor 112, the resistor 113 and a common collector of NPN transistors 119 and 120 through a buffer 111.

In the comparator 118 for cutting the primary current off, an inverted input terminal is supplied with a reference voltage (obtained by dividing an output voltage Vref of a reference voltage circuit 114 by resistors 107 and 108), and a non-inverted input terminal is connected to the emitter of the IGBT 105 and supplied with a voltage of the primary current sensing resistor 106. An output terminal of the comparator 118 is connected to a base of the primary current cutoff transistor 119.

The one-shot circuit 115 receives the ignition control signal from the ECU 101 and supplies a low-level signal to a base of the transistor 120 for a predetermined time when triggered by the trailing edge of the ignition control signal.

A comparator 116 and a transistor 117 constitute communication device for making the ECU 101 recognize the fact that the primary current has reached a value not smaller than the set value. Similarly to the comparator 118, in the comparator 116, an inverted input terminal is supplied with the reference voltage of the voltage-dividing resistor 107, and a non-inverted input terminal is supplied with the voltage of the primary current sensing resistor 106. An output terminal of the comparator 116 is connected to a base of the transistor 117. In the transistor 117, a collector is connected to a signal input terminal of the ECU 101 through the signal line 51 and the signal output terminal 50, and an emitter is connected to the ground.

The operation of this embodiment will be described with reference to the time chart of FIG. 7.

When the level of the ignition control signal (a) from the ECU 101 becomes high, the OR gate 110 outputs a high-level signal. As a result, the IGBT 105 turns on so that the primary current (g) flows in the primary winding of the ignition coil 102. When the primary current (g) has reached a value not smaller than the set value, a voltage drop in the primary current sensing resistor 106 becomes a value not lower than the reference voltage (f) of the comparators 118 and 117 to thereby turn the transistors 119 and 117 on. With the turning-on of the transistor 117, the level of the output terminal 50 changes to a low level. The level change at the output terminal 50 is supplied to the ECU 101 through the signal line 51 so as to serve as a signal (b) for making the ECU 101 recognize the fact that the primary current has reached a value not smaller than the set value.

As described above, the primary current subjected to conduction control in the first-time in repeated multiple discharge needs to be cut off in timing accurately calculated by the ECU 101. In this embodiment, therefore, the aforementioned recognition signal has no relation to the cutoff timing of the ignition control signal output from the ECU 101.

Incidentally, when the voltage drop in the current sensing resistor 106 is not lower than Vbe of the transistor 109 in the first-time primary current conduction control, the transistor 109 turns on to thereby reduce the gate voltage of the IGBT 105. As a result, the IGBT 105 is unsaturated, so that the primary current is limited.

When the level of the ignition control signal changes from a high level to a low level, the output level of the OR gate 110 becomes low. Accordingly, the IGBT 105 turns off, so that the primary current is cut off. As a result, a high voltage (h) is generated on the secondary winding of the ignition coil 102, and the ignition plug 104 discharges, so that the secondary current flows.

On the other hand, the output level (c) of the one-shot circuit 115 is reduced to a low level for a predetermined time in accordance with the timing of the level change of the ignition control signal from a high level to a low level. During this predetermined time, the NPN transistor 120 is off and the collector level of the transistor 120 is increased to a high level by the reference voltage, so that the capacitor 112 is charged with the voltage (d) with the time constant defined by the capacitor 112 and the resistor 113. When the voltage (d) of the capacitor 112 has reached a value not lower than the threshold of a buffer 111, the buffer 111 and, accordingly, the OR gate 110 output a high level signal. As a result, the IGBT 105 turns on again, so that the primary current flows again. In this case, the primary current rises so as to jump up because current conduction is performed again before discharge of the previously generated secondary voltage is totally completed. When the primary current has reached a value not smaller than the set value, and when the voltage drop in the current sensing resistor 106 is increased to a value not lower than the reference voltages of the comparators 118 and 116, the levels of the comparators 118 and 116 become high to turn the transistors 119 and 117 on. With the turning-on of the transistor 117, the level of the recognition signal changes. On the other hand, with the turning-on of the transistor 119, the capacitor voltage A' approaches 0 V instantaneously. Accordingly, the output level of the buffer 111 becomes low, so that the IGBT 105 turns off. As a result, the primary current is cut off and the secondary voltage is induced. By the aforementioned operation, the circuit for charging/discharging the capacitor 112 is formed as an ignition control signal generator.

When the primary current is cut off, the potential of the current sensing resistor 106 is reduced. Accordingly, the output levels of the comparators 118 and 116 become low, so that the transistors 119 and 117 turn off. As a result, the capacitor 112 is charged again with the predetermined time constant. This charging operation is repeated in the one-shot time so that repeated multiple ignition is achieved. Incidentally, the ECU 101 further includes monitor unit

101*d* which receives the recognition signal (b) as an input signal for judging whether repeated ignition control is performed accurately or not.

Incidentally, the one-shot time may be controlled by the ECU 101. In this case, controlling can be made so as to change the operating time of multiple ignition.

Also in conduction/cutoff control of the primary current in the second-time et seq., current is limited so that the transistor 109 turns on to reduce the gate voltage of the IGBT 105 to thereby make the IGBT 105 unsaturated if the voltage drop in the current sensing resistor exceeds Vbe of the transistor 109.

Also in this embodiment, it is possible to realize an ignition system in which in multiple ignition control, multiple ignition energy can be supplied to the ignition coil repeatedly and always stably without imposing any excessive load on the power switching device. Moreover, the ECU monitors the signal for making the ECU recognize the fact that the primary current has reached a value not smaller than the set value so that the ECU can diagnose whether the igniting operation is carried out normally or not.

As described above, according to the present invention, a multiple ignition system for an internal combustion engine can be realized by a novel method different from the background-art method and can be realized as an ignition system in which repeated conduction/cutoff control of the primary current can be performed stably without having any complicated configuration of the ignition circuit and in which excessive heat, or the like, is prevented from being generated in the power switching device, or the like.

What is claimed is:

1. An ignition system for an internal combustion engine, comprising an engine control unit for generating an ignition control signal for said internal combustion engine, and an ignition circuit for performing conduction/cutoff of a primary current on a primary side of an ignition coil in accordance with said ignition control signal to thereby generate a high voltage on a secondary side of said ignition coil, whereby conduction/cutoff of the primary current is controlled so as to be performed repeatedly in accordance with said ignition control signal so that the high voltage for ignition is generated twice or more in one combustion stroke of said internal combustion engine, wherein:

said ignition system further comprises communication means for detecting said primary current of said ignition coil and making said engine control unit recognize a fact that the primary current reaches a value not smaller than a set value when said communication means detects the fact; and said engine control unit is set so that cutoff timing in a second-time et seq. of the repeated conduction/cutoff control of the primary current in one combustion stroke is determined in accordance with the recognition of said fact.

2. An ignition system for an internal combustion engine according to claim 1, wherein said communication means makes said engine control unit recognize the fact that said primary current reaches a value not smaller than said set value by use of an exclusive signal line which connects said ignition circuit and said engine control unit to each other.

3. An ignition system for an internal combustion engine according to claim 1, wherein:

said ignition circuit includes a variable potential circuit for reducing potential of said ignition control signal when said primary current is not smaller than said set value; and said communication means makes said engine control unit recognize the fact that said primary current reaches a value not smaller than said set value on the basis of reduction of the potential of said ignition control signal by use of a signal line through which said ignition control signal is output.

4. An ignition system for an internal combustion engine according to claim 3, wherein said variable potential circuit is provided so that the potential of said ignition control signal is reduced so as not to be lower than a threshold potential for cutoff control of said primary current, when said primary current reaches a value not smaller than said set value.

5. An ignition system for an internal combustion engine according to claim 1, wherein:

a plurality of ignition coils are provided in one ignition plug so that the plurality of ignition coils are subjected to conduction/cutoff control on the basis of said ignition control signal in a designated sequence in one combustion stroke; and said ignition system further comprises communication means which is provided for each of said plurality of ignition coils in one ignition plug for making said engine control unit recognize a fact that said primary current reaches a value not smaller than a set value in each of said ignition coils.

* * * * *